United States Patent [19]

Abrams

[11] Patent Number: 4,457,829

[45] Date of Patent: Jul. 3, 1984

[54] TEMPERATURE CONTROL METHOD FOR SERIES-CONNECTED REACTORS

[75] Inventor: Lawrence M. Abrams, Miami, Fla.

[73] Assignee: HRI, Inc., Gibbsboro, N.J.

[21] Appl. No.: 416,184

[22] Filed: Sep. 9, 1982

[51] Int. Cl.[3] ..... C10G 65/10; C10G 65/12

[52] U.S. Cl. ..... 208/49; 208/59; 208/97; 208/103; 208/365

[58] Field of Search ..... 208/59, 97, 100, 103, 208/49, 60, 58, 210, 361, 365; 585/910

[56] References Cited

U.S. PATENT DOCUMENTS

| | | | |
|---|---|---|---|
| 3,215,617 | 11/1965 | Burch et al. | 208/59 |
| 3,322,665 | 5/1967 | Chervenak et al. | 208/97 |
| 3,362,903 | 1/1968 | Eastman et al. | 208/143 |
| 3,382,168 | 5/1968 | Wood et al. | 208/264 |
| 3,384,576 | 5/1968 | Greco | 208/361 |
| 3,492,220 | 1/1970 | Lempert et al. | 208/144 |
| 3,506,567 | 4/1970 | Barger, Jr. et al. | 208/89 |
| 3,623,974 | 11/1971 | Mounce et al. | 208/97 |
| 3,784,466 | 1/1974 | Arnold et al. | 208/361 |
| 3,887,455 | 6/1975 | Hamner et al. | 208/112 |
| 4,130,476 | 12/1978 | Loboda | 208/212 |

*Primary Examiner*—Delbert E. Gantz
*Assistant Examiner*—O. Chaudhuri
*Attorney, Agent, or Firm*—Vincent A. Mallare

[57] ABSTRACT

A method for controlling the temperature and composition of a vapor feedstream into a second reactor connected in series flow arrangement with a first reactor. The effluent stream from the first reactor containing vapor and liquid fractions is first cooled against a vapor stream and then further cooled against a suitable external fluid, then is phase separated to provide vapor and liquid fractions. The separated vapor fraction is reheated against the first reactor effluent stream and passed at an intermediate temperature into the second reactor. The first reactor is preferably an ebullated bed type catalytic reactor and the second reactor is preferably a fixed bed type catalytic reactor which is operated at an inlet temperature 20°-200° F. lower than the first reactor effluent stream temperature. If desired, the effluent stream from the first reactor can be initially phase separated into vapor and liquid factions, and the vapor fraction only passed to the first heat exchange step for cooling to a first lower temperature.

20 Claims, 2 Drawing Figures

TEMPERATURE CONTROL METHOD FOR SERIES-CONNECTED REACTORS

BACKGROUND OF INVENTION

This invention pertains to a method of providing temperature control for series-connected reactors. It pertains particularly to a temperature control arrangement and method for a vapor feed stream into a fixed bed type second reactor located downstream from an ebullated bed catalytic first reactor.

Catalytic reactors are often operated in series flow arrangement, and sometimes it is particularly desirable to feed a vapor fraction from a first reactor such as an ebullated catalyst bed reactor into a second fixed bed catalytic reactor for further processing. It is also desirable to independently control the reaction temperatures in each reactor in an effective and thermally efficient manner. Such control of feed conditions into the second reactor has usually required additional process steps and often requires undesirable reductions in pressure for the feed to the second reactor. U.S. Pat. No. 3,322,665 to Chervenak et al discloses a two-stage hydroconversion process for a petroleum feed in which effluent from a first reactor is cooled against recycle hydrogen upstream of a second reactor. The present invention provides a convenient and practical method for controlling the vapor feed temperature and composition into a second reactor relatively independently of the first reactor outlet temperature, by using a series-connected heat exchanger arrangement with only minimal reduction in feedstream pressure to the second reactor.

SUMMARY OF INVENTION

This invention provides a method for controlling the temperature and composition of a vapor feedstream into a second reactor connected in series with a first reactor. More specifically, the method comprises cooling a first reactor effluent stream containing vapor and liquid fractions at a first temperature to a first lower temperature by a first heat exchange step against a vapor stream obtained from a downstream phase separation step; and then cooling further said cooled effluent stream at said first lower temperature against an externally-supplied cooling fluid in a second heat exchange step to a second lower temperature. Next the vapor and liquid fractions are separated from said further cooled effluent stream, and at least a portion of said vapor fraction is reheated by heat exchange with said first reactor effluent stream in the first cooling step to provide a temperature intermediate the first temperature and second lower temperatures, then feeding said reheated vapor fraction at said intermediate temperature to a second reactor.

The first reactor is preferably an ebullated bed type catalytic reactor, and the second reactor is preferably a fixed bed type catalytic reactor. The inlet intermediate temperature to the second reactor is usually controlled at 20°–200° F. below the effluent stream first temperature from the first reactor.

If the first reactor effluent stream contains excessive or undesired liquid fractions, an upstream phase separation step can be provided between the first reactor and the first heat exchange step for the first reactor effluent stream. Thus, the effluent stream from the first reactor can be initially phase-separated into vapor and liquid fractions, and the resulting vapor fractions only passed to the first heat exchange step for cooling to a first lower tempeature. Accordingly, in an alternative embodiment, the present invention includes a method for controlling the reactor temperature and feed composition for a second reactor series-connected to a first reactor, which method comprises separating from a first reactor effluent stream containing vapor and liquid fractions a first vapor fraction at a first temperature, and cooling said vapor fraction to a first lower temperature by a first heat exchange step against a vapor stream obtained from a downstream phase separation step, then cooling further said cooled first vapor fraction at said first lower temperature against an externally-supplied cooling fluid in a second heat exchange step to a second lower temperature, then separating vapor and liquid fractions from said further cooled first vapor fraction and providing a second vapor fraction; followed by reheating at least a portion of said separated second vapor fraction by heat exchange with said first vapor fraction in said first cooling step to provide a temperature intermediate of said first temperature and second lower temperatures; and then feeding said reheated second vapor fraction at said intermediate temperature to a second reactor.

It is also an advantage of the present invention that by cooling the first reactor effluent stream to a temperature below the desired inlet temperature to the second reactor, undesirable heavy liquid fractions in the stream are condensed and removed in a phase separation step, and thus do not enter the second reactor, which is usually a fixed catalytic bed reactor which is subject to fouling and possible plugging of the catalyst bed by heavy liquid materials.

DETAILED DESCRIPTION OF INVENTION

Figure 1:
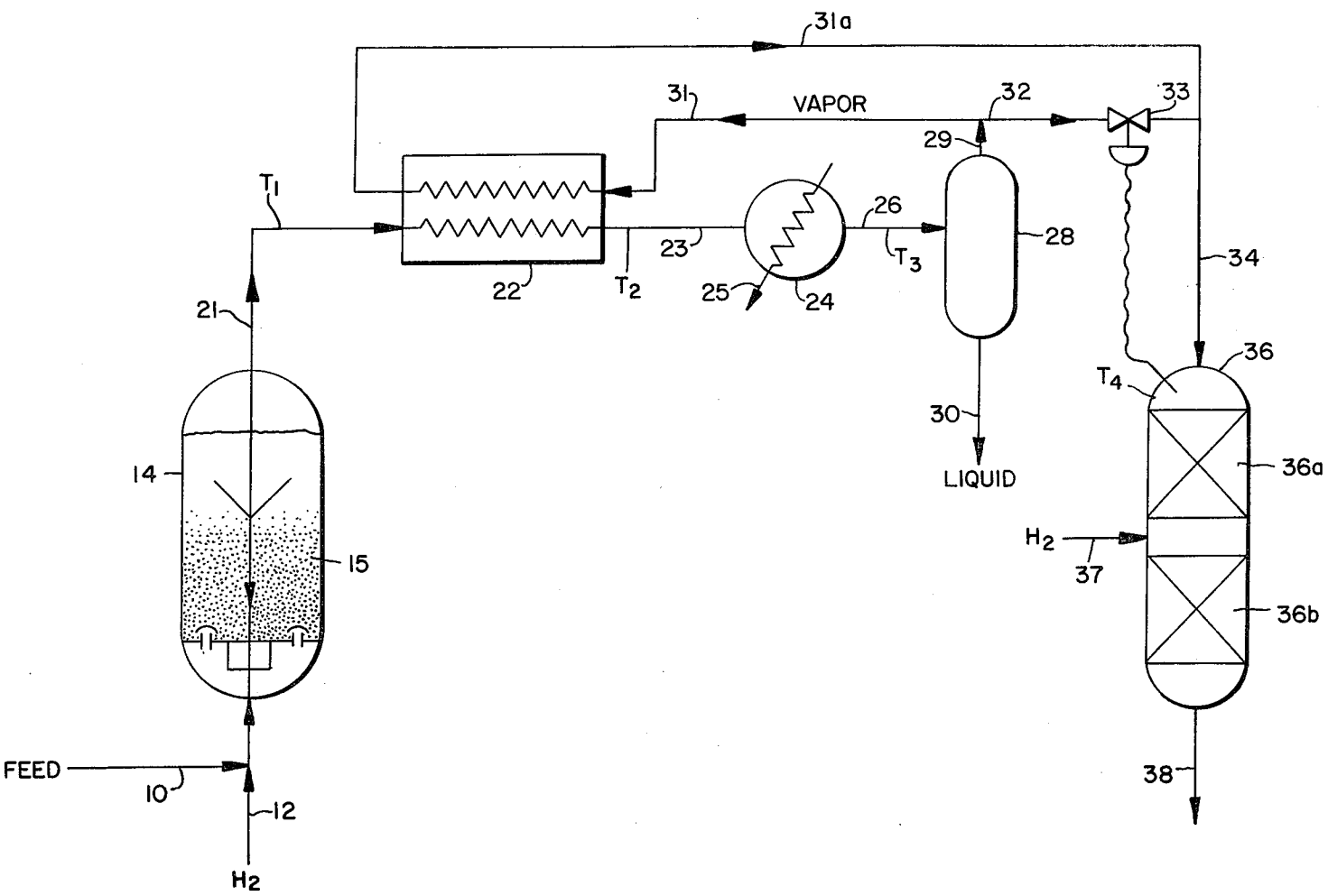
FIG. 1 is a schematic flow diagram showing a temperature control arrangement for two reactors connected in series flow arrangement in accordance with the invention.

The invention will now be described in greater detail with reference to FIG. 1. A hydrocarbon feedstream 10, such as a petroleum crude oil or a petroleum resid material or a hydrocarbon material derived from shale or tar sands, together with hydrogen 12 are fed into a first reactor 14, which preferably contains an ebullated bed of catalyst 15. In reactor 14, the hydrocarbon feed material is catalytically hydroconverted to produce hydrocarbon gas and liquid fractions. Operation of the ebullated bed reactor 14 is similar to that disclosed in U.S. Pat. No. Re. 25,770 to Johanson, which is incorporated herein by reference to the extent necessary.

From reactor 14 effluent stream 21, containing hydrogen gas together with hydrocarbon vapor and liquid fractions, is withdrawn at a first temperature T1, and passed to first heat exchanger 22 for initial cooling of the effluent stream to a first lower temperature T2. Further cooling of the effluent material 23 is provided in heat exchanger 24 to a controlled second lower temperature T3 against an externally-provided cooling fluid 25, which is preferably hydrogen gas which can be used in reactor 14.

From heat exchanger 24, the cooled fluid at 26 which is at temperature T3 usually 50°–200° F. below the first temperature T1 of reactor effluent 21, is passed into phase separator 28 from which vapor stream 29 and liquid fraction stream 30 are withdrawn. A portion 31 of vapor stream 29 is reheated in first heat exchanger 22, against stream 21 to provide reheated stream 31*a*. The remaining vapor portion is bypassed through conduit 32 containing control valve 33 and together with reheated stream 31*a* forms stream 34 at an intermediate temperature T4. Stream 34 is then fed into fixed bed reactor 36, containing fixed catalyst beds 36*a* and 36*b*. Hydrogen stream 37 is introduced into reactor 36 between catalysts 36*a* and 36*b* to cool and control the vapor temperature into bed 36*b*. Reacted stream 38 is withdrawn and passed to further processing steps as desired, such as distillation steps.

Figure 2:
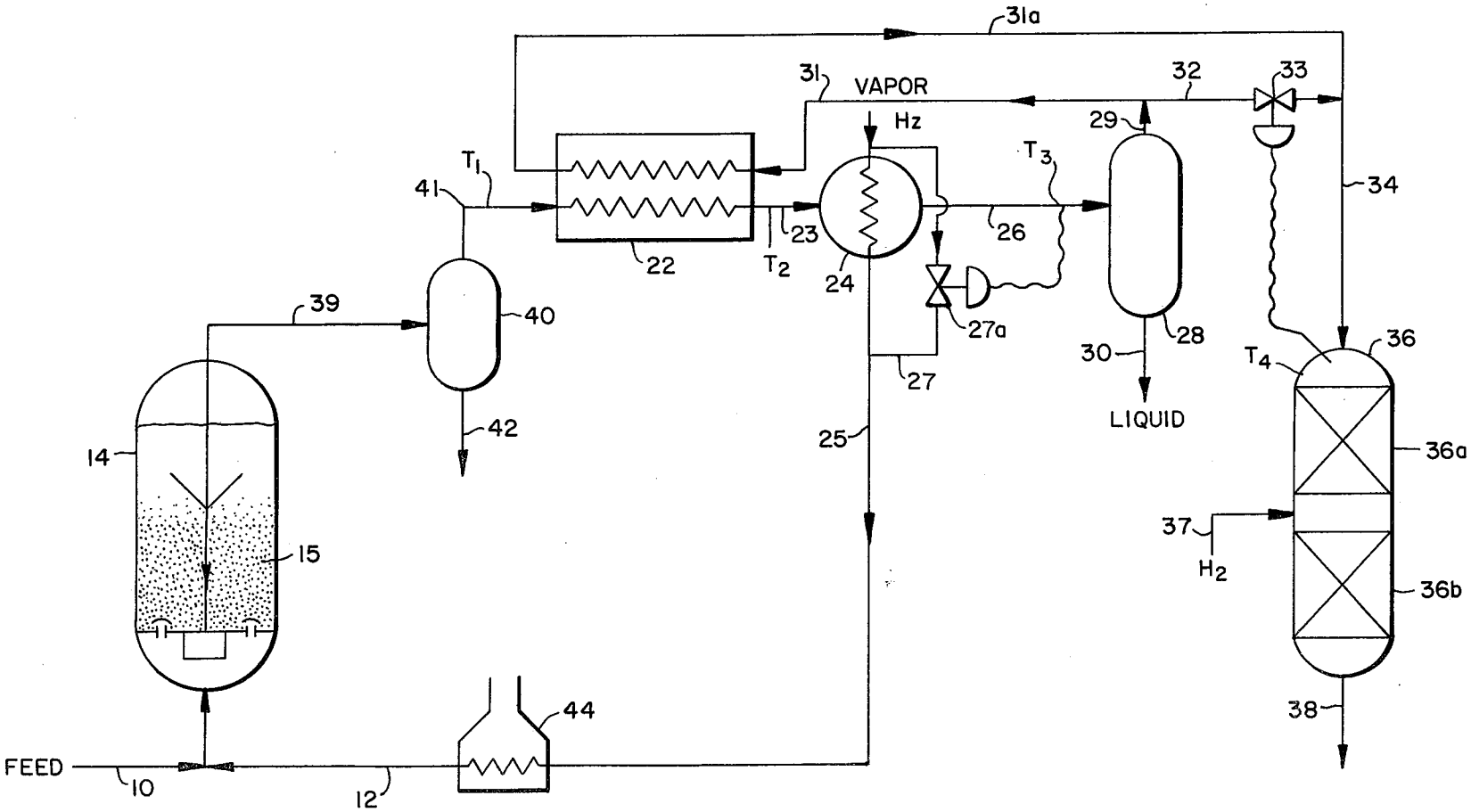
FIG. 2 is a schematic flow diagram of an alternative embodiment of the invention.

For hydrocarbon feedstreams for which the first reactor effluent stream 21 contains sufficient heavy high boiling liquid materials that would tend to foul the flow passages in heat exchangers 22 and 24, an initial or upstream phase separation step 40 is preferably provided between first reactor 14 and first heat exchanger 22. For this embodiment of the invention as shown in FIG. 2, reactor effluent stream 39 from first reactor 14 is initially passed into phase separator 40, from which a first vapor stream 41 at a first temperature T1 then passes into first heat exchanger 22 for cooling to first lower temperature T2. From separator 40, liquid fraction 42 is passed to further processing steps as desired (not shown). If desired to control temperature T3 of vapor stream 26, a portion of hydrogen gas cooling fluid 25 is usually bypassed around heat exchanger 24 through conduit 27 containing control valve 27*a*. Opening valve 27*a* increases the flow in bypass 27, which reduces the cooling for vapor stream 26 and causes temperature T3 to rise. Similarly, closing valve 27*a* increases the cooling in heat exchanger 24 by stream 25 and causes temperature T3 to decline. The hydrogen gas cooling fluid 25 used in heat exchanger 24 is reheated at heater 44 as needed and then introduced into reactor 14 together with the hydrocarbon feedstream 10.

This invention will be better understood by reference to the following example involving use of the reactor control method, which should not be regarded as limiting in scope.

EXAMPLE 1

A hydrocarbon effluent stream containing vapor and liquid fractions is withdrawn from an ebullated bed catalytic reactor at 800° F. temperature and 2000 psig pressure, and is cooled in a first heat exchanger to 725° F. against a vapor stream obtained from a downstream phase separation step. The effluent stream is further cooled in a second heat exchanger against hydrogen to 600° F., and then phase separated to remove a vapor fraction having a composition resulting from the phase separation temperature. A portion of this vapor fraction is recycled to the first heat exchange step and warmed to 675° F., then fed into the upper end of a second reactor containing a fixed catalyst bed. The remaining portion of the separated vapor fraction is bypassed through a control valve before being mixed with the recycled vapor fraction to obtain mixed stream temperature of 660° F. at the inlet to the second reactor. When it is desired to increase the inlet temperature into the second reactor, the bypass flow control valve is closed slightly thus increasing the vapor flow being warmed by the first heat exchanger.

For operations near the end of a run when catalytic activity in the second reactor has declined, the effluent stream withdrawn from the ebullated bed catalytic first reactor at about 800° F. is cooled in the first heat exchanger to about 650° F., then further cooled in the second heat exchanger to 600° F. prior to the phase separation step. A major portion of the resulting vapor fraction is rewarmed in the first heat exchanger to about 750° F., then fed into the upper end of the fixed bed second reactor. The remaining portion of the separated vapor fraction is bypassed through the control valve and mixed with the major vapor portion to obtain a mixed stream temperature of about 725° F. at the inlet to the fixed bed second reactor.

Although this invention has been described broadly and in terms of various specific embodiments, it will be understood that modifications and variations can be made and some steps used without others all within the spirit and scope of the invention, which is defined by the following claims.

I claim:

1. A method for controlling the reactor temperature and hydrocarbon feed composition for a second reactor series-connected to a first reactor, comprising:

(a) cooling a first reactor effluent stream at 700°–850° F. temperature and containing vapor and liquid fractions from a first temperature to a first lower temperature by a first heat exchange step against a vapor stream obtained from a downstream phase separation step;

(b) cooling further said cooled effluent stream at said first lower temperature against an externally supplied cooling fluid in a second heat exchange step to a second lower temperature;

(c) separating vapor and liquid fractions from said further cooled effluent stream;

(d) reheating at least a portion of said separated vapor fraction by heat exchange with said first reactor effluent stream in said cooling step (a) to provide a temperature of 650°–830° F. which is intermediate of said first temperature and second lower temperatures; and (e) feeding said reheated hydrocarbon vapor fraction at said intermediate temperature of 650°–830° F. to a second reactor.

2. The temperature control method of claim 1, wherein said first reactor is an ebullated bed type catalytic reactor.

3. The temperature control method of claim 1, wherein said second reactor is a fixed bed type catalytic reactor.

4. The temperature control method of claim 1, wherein said inlet intermediate temperature to said second reactor is 20°–200° F. below the effluent stream first temperature from said first reactor.

5. The temperature control method of claim 1, wherein said external cooling fluid is a hydrogen-rich gas stream.

6. The temperature control method of claim 1, wherein a major portion of said vapor fraction is passed to said first cooling step for reheating the vapor in heat exchange with said first reactor effluent stream so as to control the intermediate temperature to said second reactor.

7. The temperature control method of claim 1, wherein said further cooling in a second heat exchange to said second lower temperature controls the composition of the separated vapor fraction stream.

8. The temperature control method of claim 1, wherein a minor portion of said vapor fraction is passed through a flow control valve directly to said second reactor, and wherein closing the flow control valve increases the intermediate temperature of said vapor feed to said second reactor.

9. The temperature control method of claim 5, wherein said hydrogen-rich gas is fed into said first reactor.

10. The temperature control method of claim 1, wherein said first reactor effluent stream containing vapor and liquid fractions is phase separated in an upstream phase separation step provided between said first reactor and said first heat exchanger, and the resulting vapor fraction is then cooled in said first heat exchange step to said first lower temperature.

11. A method for controlling the reactor temperature and hydrocarbon vapor feed composition for a second reactor series-connected to a first reactor, comprising:

(a) cooling a first effluent stream at 700°–850° F. temperature and containing vapor and liquid fractions at a first temperature to a first lower temperature by a first heat exchange against a vapor stream obtained from a downstream phase separation step;

(b) cooling further said cooled effluent stream at said first lower temperature against an externally supplied cooling fluid in a second heat exchange to a second lower temperature;

(c) separating vapor and liquid fractions from said further cooled effluent stream;

(d) reheating at least a portion of said separated vapor fraction by heat exchange with said first reactor effluent stream in said cooling step (a) to provide a temperature of 650°–830° F. which is intermediate of said first and second lower temperatures; and (e) feeding said reheated hydrocarbon vapor fraction at said intermediate temperature which is 50°–200° F. below said first temperature to a second reactor containing a fixed type catalyst bed.

12. A method for controlling the reactor temperature and hydrocarbon feed composition for a second reactor series-connected to a first reactor, comprising:

(a) separating from a first reactor effluent stream at 700°–850° F. and containing hydrocarbon vapor and liquid fractions a first vapor fraction at a first temperature, and cooling said vapor fraction to a first lower temperature by a first heat exchange step against a vapor stream obtained from a downstream phase separation step;

(b) cooling further said cooled first vapor fraction against an externally-supplied cooling fluid in a second heat exchange step to a second lower temperature;

(c) separating vapor and liquid fractions from said further cooled first vapor fraction and providing a second vapor fraction;

(d) reheating at least a portion of said separated second vapor fraction by heat exchange with said first vapor fraction in said cooling step (a) to provide a temperature of 650°–830° F. which is intermediate of said first temperature and second lower temperatures; and (e) feeding said reheated hydrocarbon second vapor fraction at said intermediate temperature of 650°–830° F. to a second reactor.

13. The temperature control method of claim 12, wherein said first reactor is an ebullated bed type catalytic reactor.

14. The temperature control method of claim 12, wherein said second reactor is a fixed bed type catalytic reactor.

15. The temperature control method of claim 12, wherein said inlet intermediate temperature to said second reactor is 20°–200° F. below the effluent stream first temperature from said first reactor.

16. The temperature control method of claim 12, wherein said first reactor effluent is a hydrocarbon-hydrogen mixture at 700°–850° F. temperature, and the feed to said second reactor is a hydrocarbon vapor fraction at 650°–830° F. temperature.

17. The temperature control method of claim 12, wherein said external cooling fluid is a hydrogen-rich gas stream.

18. The temperature control method of claim 12, wherein a major portion of said vapor fraction is passed to said first cooling step for reheating the vapor in heat exchange with said first reactor effluent stream so as to control the intermediate temperature to said second reactor.

19. The temperature control method of claim 12, wherein said further cooling in a second heat exchange to said second lower temperature controls the composition of said second vapor fraction stream.

20. The temperature control method of claim 12, wherein a minor portion of said vapor fraction is passed through a flow control valve directly to said second reactor, and wherein closing the flow control valve increases the intermediate temperature of said vapor feed to said second reactor.

* * * * *